United States Patent [19]

Freisinger et al.

[11] Patent Number: 4,699,397

[45] Date of Patent: Oct. 13, 1987

[54] ADJUSTING DEVICE FOR SKI BINDINGS

[75] Inventors: Henry Freisinger; Karl Stritzl, both of Vienna, Austria

[73] Assignee: TMC Corporation, Baar/Zug, Austria

[21] Appl. No.: 880,865

[22] Filed: Jul. 1, 1986

[30] Foreign Application Priority Data

Jul. 5, 1985 [AT] Austria ..... 1996/85

[51] Int. Cl.[4] ..... A63C 9/00

[52] U.S. Cl. ..... 280/633

[58] Field of Search ..... 280/633, 634, 636, 605, 280/621, 607

[56] References Cited

U.S. PATENT DOCUMENTS

| | | | |
|---|---|---|---|
| 3,950,001 | 4/1976 | Weigl | 280/633 |
| 4,022,493 | 5/1977 | Weigl | 280/633 |
| 4,500,108 | 2/1985 | Johnson | 280/633 |

*Primary Examiner*—David M. Mitchell

*Attorney, Agent, or Firm*—Flynn, Thiel, Boutell & Tanis

[57] ABSTRACT

An adjusting device having a carriage supporting a binding part, and a base plate supported on the ski and serves to guide the carriage for movement relative to the ski, whereby one of the carriage and the base plate is equipped with serrations which extend in a longitudinal direction of a ski, with which is associated a locking member which is guided on the other of the carriage and the base plate for movement transversely with respect to the longitudinal direction of the ski and has locking teeth thereon. In order to create in this adjusting device a positive locking of the teeth of the locking member with respect to the serrations, the invention provides that one end of an intermediate member be hinged to a locking member or to a swivel part which is hingedly connected to the locking member. The intermediate member is pivotal between first and second positions located on opposite side of a dead-center position thereof. The other end of the intermediate member is hingedly supported on the carriage which carries the locking member and which, in the locked condition of the adjusting device, is provided in a second position on an opposite side of a dead-center position from said first position.

9 Claims, 3 Drawing Figures

ADJUSTING DEVICE FOR SKI BINDINGS

FIELD OF THE INVENTION

The invention relates to an adjusting device for facilitating the adjustment of the position of a ski part along the length of a ski.

BACKGROUND OF THE INVENTION

Such an adjusting device has already been described in Austrian Pat. No. 350 499. A locking member of this adjusting device is under the influence of a pressure spring, which urges the teeth of the locking member into serrations provided in an edge of an elongated strip; thus the locking is frictional. Since the teeth have generally, in a top view, the design of isosceles triangles, it can happen that the pressure onto the binding part is too great so that the force of the pressure spring is overcome and the locking member is moved along the serrations, which results in damage to the teeth both on the locking member and also to the serrations on the strip.

The purpose of the invention is to overcome this disadvantage and to provide an adjusting device in which the locking of the teeth on the locking member occurs through a positive form locking device.

This purpose is inventively attained by the provision of a locking member which is fixed by a force-locking arrangement in the locked condition by an intermediate member, so that an unintended opening of the adjusting device is not possible.

A slight deformation of the intermediate member is made possible by making the intermediate member of spring-steel wire, which makes the operation easier.

A split design of the locking member is not absolutely necessary for the proper functioning of the adjusting device. Of course, a nonsplit design assumes a substantially generous play between the locking member and the carriage, which at times is undesired. The amount of play can be reduced considerably when an axle joint is provided on the locking member, since the area of the locking member, which area carries the locking teeth, is no longer being swivelled, but is only being moved.

BRIEF DESCRIPTION OF THE DRAWINGS

The drawings illustrate one exemplary embodiment of the subject matter of the invention, namely.

DETAILED DESCRIPTION

Figure 1:
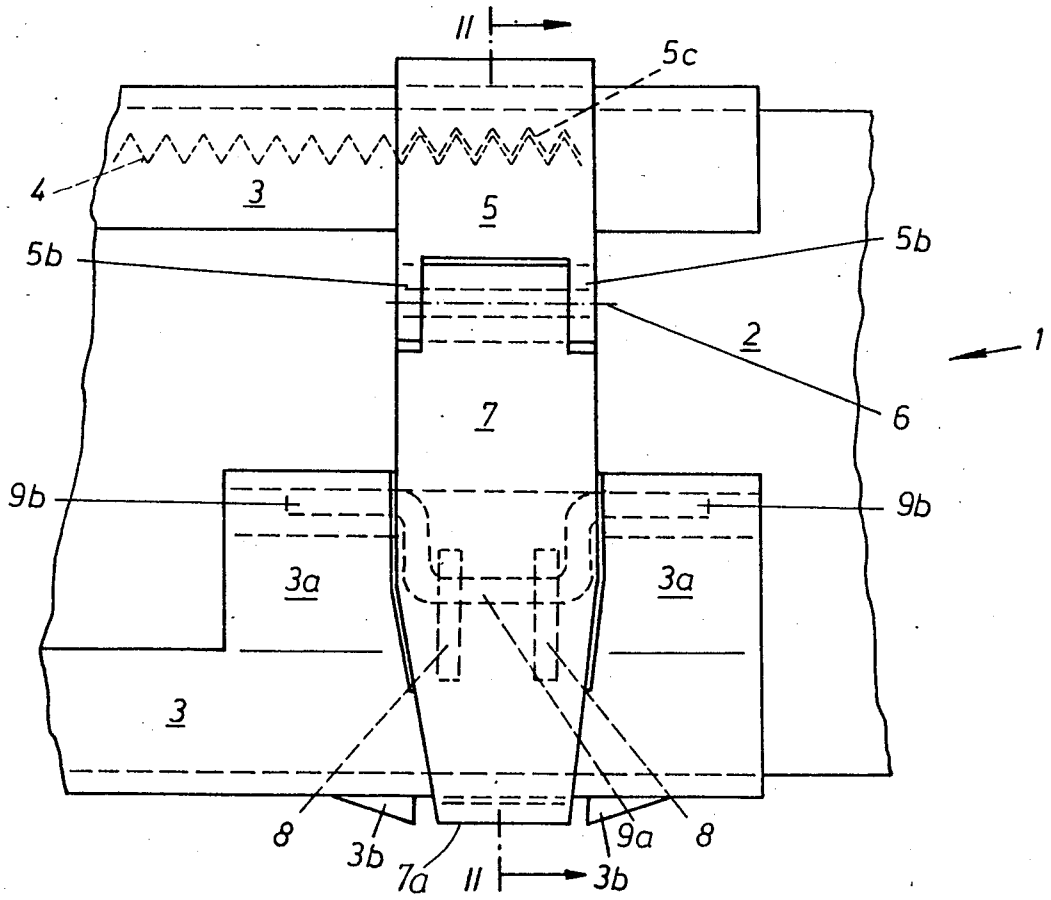
FIG. 1 is a top view of an adjusting device in the locked position.

The adjusting device is identified as a whole by the reference numeral 1. It has an elongated base plate 2, which extends in the longitudinal direction of the ski, and a carriage 3, which is movably guided along the base plate. A groove 2*a* is provided in the base plate 2, which groove extends in the longitudinal direction of the base plate and in which is provided an elongated array of serrations 4. A locking member 5 is mounted on the carriage 3 and has an end segment 5*a* which is bent at 180° and has plural locking teeth 5*c* received in the groove 4. The locking member 5 has two bearing plates 5*b* to which is attached an axle 6. A swivel part 7 is pivotally supported on the axle 6, which swivel part can be pivoted manually. The swivel part 7 has on its underside two bearing plates 8. Each plate is provided with a slot and receives therein a crank arm 9*a* of an intermediate member 9 designed as a crankshaft. The main bearings 9*b* of the intermediate member 9 are defined by tabs 3*a* on the carriage 3, the free ends of which tabs are bent at 180°. The tabs 3*a* are slightly bent or angled upwardly and thus straddle and form a lateral guide for the locking member 5. The free end 7*a* of the swivel part 7, which is bent at 90° and projects beyond the carriage 3 and is used to facilitate a manual engagement thereof. Two sloped projections 3*b* project from the sidewall of the carriage 3 adjacent to the end 7*a*. The projections 3*b* serve to protect the end 7*a* against damage.

Figure 2:
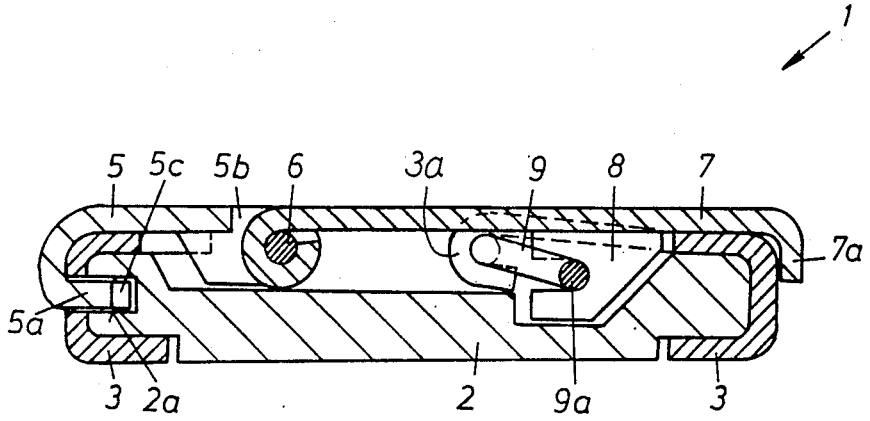
FIG. 2 is a cross-sectional view taken along the line II—II of FIG. 1.
Figure 3:
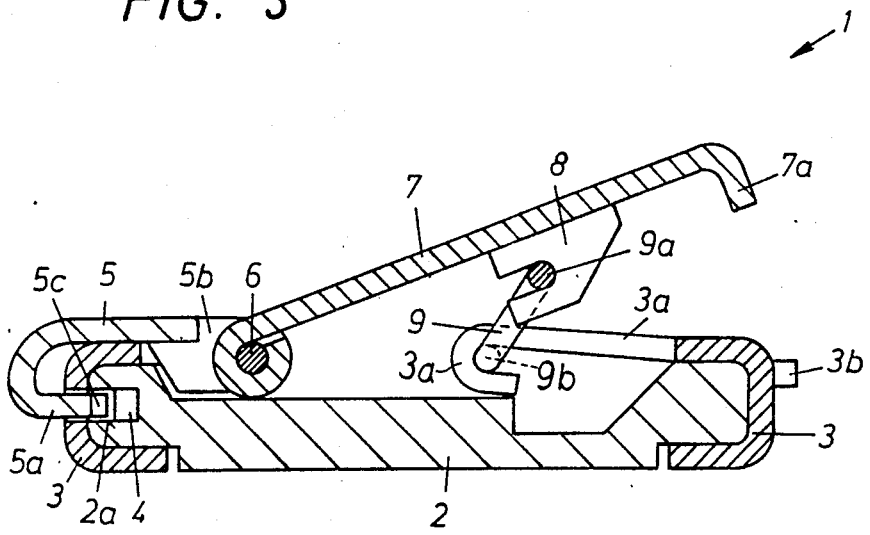
FIG. 3 is a cross-sectional view of the adjusting device in the released position.

The adjusting device 1 is, during skiing, in the position which is illustrated in FIGS. 1 and 2. The locking teeth 5*c* of the locking member 5 engage in this position several of the serrations 4 (see FIG. 3), and the crank arm 9*a* of the intermediate member 9 is on the other side of a dead-center position, namely below a plane which extends through the axle 6 and parallel with respect to the base plate 2. The swivel part 7 thus functions as a tensioning means or toggle lever for facilitating an urging of the teeth 5*c* of the locking member 5 under a pregiven force into engagement with the serrations 4. Further, this construction keeps the angle of transverse of the swivel part 7 small.

If the adjusting device is to be released, then the end segment 7*a* of the swivel part 7 is to be lifted manually. The crank arm 9*a* of the intermediate member 9 is thereby swung upwardly beyond the aforesaid dead-center position. The locking member is at the same time moved to the left in FIG. 3, so that the teeth 5*c* of the locking member 5 become disengaged from the serrations 4. The carriage 3 can now be moved along the base plate 2 until the desired position of the carriage 3 is reached. The swivel part 7 is subsequently pressed down by the hand of the user and the adjusting task is completed.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In an adjusting device for ski bindings, in particular for sole plates, having a carriage with a ski binding part thereon movably supported on a base plate supported on a ski and serves as a guide for said carriage, whereby one of said carriage and said base plate is equipped with an elongated array of serrations which extend in a longitudinal direction of said ski and with which is associated a locking member which is provided with locking teeth and which is guided on the other of said carriage and said base plate transversely with respect to the longitudinal direction of the ski, the improvement comprising wherein one end of an intermediate member is hingedly connected by a first hinge means to a swivel part which is hingedly connected to said locking member by a second hinge means, said intermediate member being movable between first and second positions, the other end of said intermediate member being hingedly supported on said carriage which, carriage supports said locking member, by a third hinge means, and wherein, in said locked condition of said adjusting device, said intermediate member is in said second position and said first hinge means is on an opposite side of a dead-center position, defined by said first and third hinge means being in a plane parallel to an upwardly facing side of said ski, from a position thereof when said intermediate member is in said first position, and said locking teeth are engaged with said serrations.

2. An adjusting device according to claim 1, wherein said intermediate member is a spring-steel wire.

3. An adjusting device according to claim 1, wherein said intermediate member is constructed as a crankshaft, said third hinge means thereof being supported on said carriage, and said first hinge means defined by a crank arm of said crankshaft being supported in bearing blocks on said swivel part.

4. An adjusting device according to claim 1, wherein said swivel part, with a ski shoe inserted into said ski binding, is held by said ski shoe in said locked condition of said adjusting device.

5. An adjusting device according to claim 1, wherein said second hinge means is defined by an axle provided on said locking member and which extends in a longitudinal direction of said ski.

6. An adjusting device according to claim 5, wherein said second hinge means further comprises a part of said locking member and a part of said swivel part, which parts are pivotally connected by adjacent to said locking teeth of said locking member.

7. An adjusting device for use in facilitating an adjustment of the position of a ski binding on a ski, comprising:

a base plate adapted to be mounted on said ski and having guide means thereon;

a carriage means mounted on said base plate and being guided for movement thereon by said guide means;

an elongated array of serrations on said base plate;

a swivel part and support means for movably supporting said swivel part for movement between first and second positions and about an axis that extends generally parallel to said longitudinal central axis, said first position of said swivel part being inclined upwardly from an upwardly facing surface on said base plate, said support means having locking teeth thereon engagable with selected ones of said serrations;

an intermediate member hingedly connected at one end by a first hinge means to said swivel part and at the other end by a second hinge means to said carriage means, the position of said second hinge means being fixed relative to said carriage means, said intermediate member being movable between third and fourth positions in response to movements of said swivel part between said first and second positions, said locking teeth on said support means being spaced from said serrations in an unlocked condition which occurs when said swivel part is in said first position and said intermediate member is in said third position, said locking teeth engaging said serrations in a locked condition which occurs when said swivel part is in said second position and said intermediate member is in said fourth position, said intermediate member effecting, in said locked condition, a drawing of said locking teeth into engagement with said serrations due to said first hinge means being moved laterally relative to a longitudinal central axis of said base plate; and means for effecting a releasable locking of said swivel part in said second position.

8. An adjusting device according to claim 7, wherein said first and second hinge means each have an axis which extends parallel to said longitudinal central axis.

9. An adjusting device according to claim 8, wherein said means for effecting a releasable locking of said swivel part in said second position includes a positioning of said axis of said first hinge means on a side of a horizontal plane containing said axis of said second hinge means when said swivel part is in said locked condition, opposite to the side on which said swivel part is located in said unlocked condition.

* * * * *

UNITED STATES PATENT AND TRADEMARK OFFICE

CERTIFICATE OF CORRECTION

PATENT NO. : 4 699 397

DATED : October 13, 1987

INVENTOR(S) : Freisinger et al.

It is certified that error appears in the above-identified patent and that said Letters Patent is hereby corrected as shown below:

Column 2, line 67; change "carriage which, carriage" to ---carriage, which carriage---.

Column 3, line 28; change "connected by adjacent to" to ---connected by said axle adjacent to---.

Signed and Sealed this

Fifth Day of April, 1988

*Attest:*

*Attesting Officer*

DONALD J. QUIGG

*Commissioner of Patents and Trademarks*